US008312722B2

(12) United States Patent
York et al.

(10) Patent No.: US 8,312,722 B2
(45) Date of Patent: Nov. 20, 2012

(54) FLAME HOLDING TOLERANT FUEL AND AIR PREMIXER FOR A GAS TURBINE COMBUSTOR

(75) Inventors: William David York, Greer, SC (US); Thomas Edward Johnson, Greer, SC (US); Willy Steve Ziminsky, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1063 days.

(21) Appl. No.: 12/256,901

(22) Filed: Oct. 23, 2008

(65) Prior Publication Data

US 2010/0101229 A1 Apr. 29, 2010

(51) Int. Cl.
*F02C 1/00* (2006.01)
*F02G 3/00* (2006.01)
*B05B 15/00* (2006.01)

(52) U.S. Cl. ..... 60/737; 60/748; 239/132.3; 239/132.5

(58) Field of Classification Search ..... 60/740, 60/742, 737–738, 748, 776, 39.463, 266, 60/39.83; 239/403, 400, 125, 139, 132–133, 239/416.4, 416.5, 418, 423, 434.5; 431/8, 431/12, 351, 352, 354
See application file for complete search history.

(56) References Cited

U.S. PATENT DOCUMENTS 2,699,358 A * 1/1955 Sonderegger ..... 239/132.3
4,781,019 A * 11/1988 Wagner ..... 60/260
4,986,068 A * 1/1991 Lee et al. ..... 60/768
5,101,633 A 4/1992 Keller et al.
6,019,596 A * 2/2000 Knopfel et al. ..... 431/350
6,438,961 B2 8/2002 Tuthill et al.
6,981,358 B2 * 1/2006 Bellucci et al. ..... 60/39.17
6,993,916 B2 2/2006 Johnson et al.
7,007,477 B2 3/2006 Widener
7,165,405 B2 * 1/2007 Stuttaford et al. ..... 60/737
7,412,833 B2 * 8/2008 Widener ..... 60/772
2006/0010878 A1 * 1/2006 Widener ..... 60/776
2006/0191268 A1 * 8/2006 Widener et al. ..... 60/772
2008/0078160 A1 4/2008 Kraemer et al.

OTHER PUBLICATIONS

Combustion Science and Technology; Burner Development and Operability Issues Associated with Steady Flowing Syngas Fired Combustors; Tim Lieuwen, Vince McDonell, Domenic Santavicca and Thomas Sattlemayer; Jun. 1, 2008; pp. 1169-1192.
http:/www.informaworld.com/smpp/title~content=t713456315;
Combustion Science and Technology; Burner Development and Operability Issues Associated with Steady Flowing Syngas Fired Combustors; Tim Lieuwen, Vince McDonell, Domenic Santavicca and Thomas Sattlemayer; Jun. 1, 2008; pp. 1169-1192.

* cited by examiner

*Primary Examiner* — Ted Kim
*Assistant Examiner* — Andrew Nguyen
(74) *Attorney, Agent, or Firm* — Cantor Colburn LLP

(57) ABSTRACT

A fuel nozzle with active cooling is provided. It includes an outer peripheral wall, a nozzle center body concentrically disposed within the outer wall in a fuel and air pre-mixture. The fuel and air pre-mixture includes an air inlet, a fuel inlet and a premixing passage defined between the outer wall in the center body. A gas fuel flow passage is provided. A first cooling passage is included within the center body in a second cooling passage is defined between the center body and the outer wall.

6 Claims, 3 Drawing Sheets

FLAME HOLDING TOLERANT FUEL AND AIR PREMIXER FOR A GAS TURBINE COMBUSTOR

FEDERAL RESEARCH STATEMENT

This invention was made with the Government support under Contract No. DE-FC26-05NT42643, awarded by the Department of Energy. The Government has certain rights in this invention.

BACKGROUND OF THE INVENTION

The subject matter disclosed herein relates to fuel and air premixers for gas turbine combustion systems, and more particularly to a cooling system that will allow flame holding without sustaining damage to the system.

The primary air polluting emissions usually produced by gas turbines burning conventional hydrocarbon fuels are oxides of nitrogen, carbon monoxide, and unburned hydrocarbons. It is well known in the art that oxidation of molecular nitrogen in air breathing engines is highly dependent upon the maximum hot gas temperature in the combustion system reaction zone. One method of controlling the temperature of the reaction zone of a heat engine combustor below the level at which thermal NOx is formed is to premix fuel and air to a lean mixture prior to combustion, often called a Dry Low NOx (DLN) combustion system. The thermal mass of the excess air present in the reaction zone of a lean premixed combustor absorbs heat and reduces the temperature rise of the products of combustion to a level where thermal NOx is significantly reduced.

There are several difficulties associated with dry low emissions combustors operating with lean premixing of fuel and air. That is, flammable mixtures of fuel and air exist within the premixing section of the combustor, which is external to the reaction zone of the combustor. Typically, there is some bulk burner tube velocity, above which a flame in the premixer will be pushed out to a primary burning zone. There is an opportunity for combustion to occur within the premixing section due to flashback, which occurs when flame propagates from the combustor reaction zone into the premixing section, or auto ignition, which occurs when the dwell time and temperature for the fuel/air mixture in the premixing section are sufficient for combustion to be initiated without flashback or other ignition event. The consequences of combustion in the premixing section, and the resultant burn in the nozzle, are degradation of emissions performance and/or overheating and damage to the premixing section. In other words, if a flame is held in the premixer, damage to the center body, burner tube, and/or vanes can occur in less than ten seconds, due to the extremely large thermal load.

With natural gas as the fuel, premixers with adequate flame holding margin may usually be designed with reasonably low air-side pressure drop. However, with more reactive fuels, such as synthetic gas ("syngas"), syngas with pre-combustion carbon-capture (which results in a high-hydrogen fuel), and even natural gas with elevated percentages of higher-hydrocarbons, designing for flame holding margin and target pressure drop becomes a challenge. Since the design point of state-of-the-art nozzles may reach a bulk flame temperature of 3000 degrees Fahrenheit, flashback into the nozzle could cause extensive damage to the nozzle in a very short period of time. Experimentation with high-hydrogen fuels and DLN premixers modified for these fuels exposes the difficulty of the state-of-the-art nozzles passing flame holding tests at engine-realistic conditions. A "passed" test is one in which a flame inside the premixer does not remain in the premixer, but rather is displaced downstream into the normal combustion zone.

BRIEF DESCRIPTION OF THE INVENTION

According to one aspect of the invention, a fuel nozzle comprising an outer peripheral wall and a nozzle center body concentrically disposed within the outer wall is provided. A fuel/air premixer including an air inlet, a fuel inlet, and a premixing passage defined between the outer wall and the center body and extending at least part circumferentially is provided. A gas fuel flow passage defined within the center body and extending at least part circumferentially is also provided. The nozzle includes a first cooling passage defined within the center body and extending at least part circumferentially thereof, and a second cooling passage defined between the center body and the outer peripheral wall.

According to another aspect of the invention, a method of cooling a fuel nozzle is provided. The fuel nozzle includes an outer peripheral wall, a nozzle center body disposed within the other wall, a fuel/air pre-mixer including an air inlet, a fuel inlet and a premixing passage defined between outer peripheral wall and the center body. At least one cooling passage is defined within the nozzle and extends at least part circumferentially thereof and a gas fuel flow passage is defined within the center body and extends at least part circumferentially thereof The method comprises flowing cooling fluid through the cooling passage and impinging the cooling fluid against an inner surface of an end face of the center body. The method further comprises flowing cooling fluid adjacent the outer wall and expelling cooling fluid into the premixing passage defined between the nozzle center body and the outer wall of the nozzle The present invention of an actively cooled premixer will allow operability of a DLN combustion system that is flame holding tolerant, thereby allowing sufficient time to detect a flame in the premixer and correct the condition with a control system. This advantageously allows combustion systems to run with syngas, high-hydrogen, and other reactive fuels with a significantly reduced risk of costly hardware damage and forced outages.

These and other advantages and features will become more apparent from the following description taken in conjunction with the drawings.

BRIEF DESCRIPTION OF THE DRAWINGS

The subject matter that is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Flame holding tolerance can be achieved with an advanced cooling system. The cooling system of the present invention comprises a combination of backside convection cooling, impingement cooling, and film cooling. The working coolant fluids may be of any known to a person of ordinary skill, which include without limitation, nitrogen, air, fuel, or some combination thereof. Therefore, the present invention allows expansion of alternative nozzle designs since nozzles need not be flame holding resistant, when used with an advanced cooling system, nozzles can be flame holding tolerant.

Figure 1:
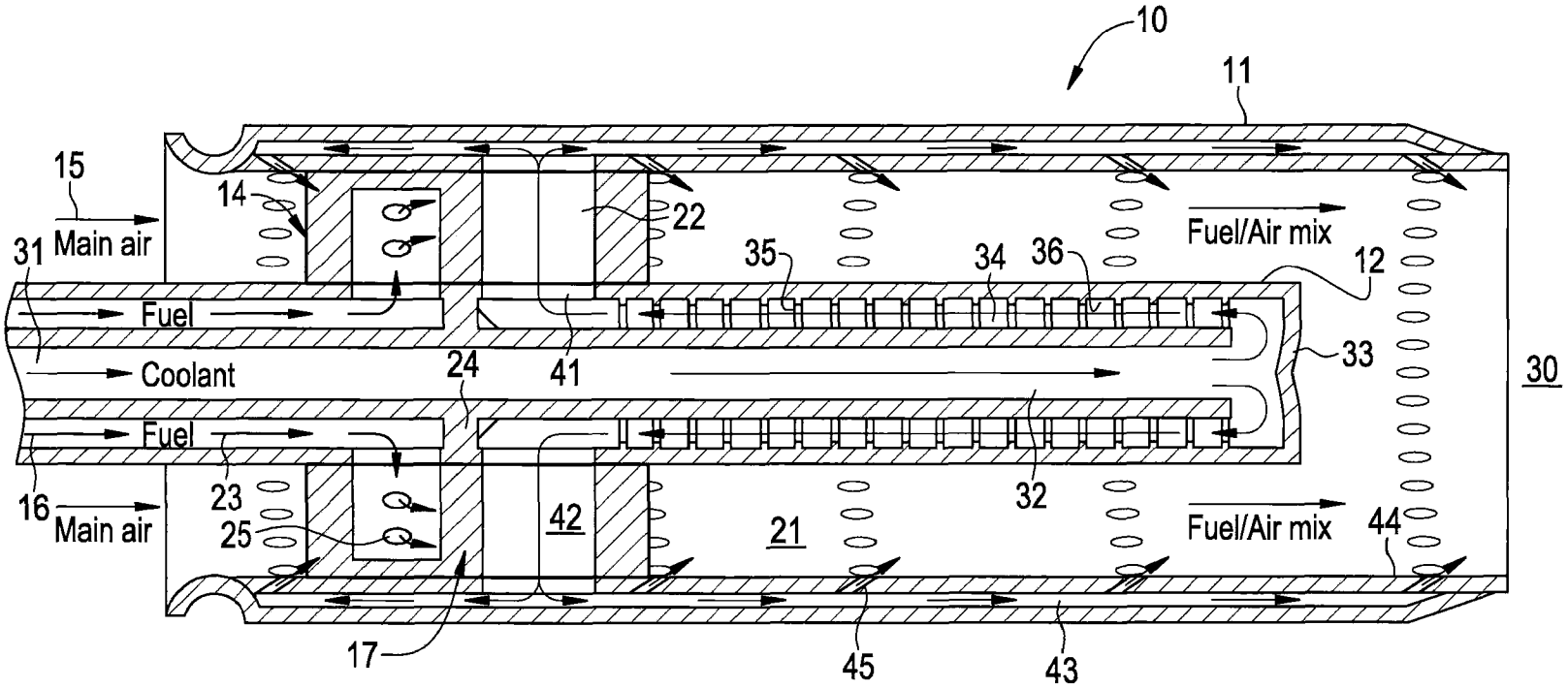
FIG. 1 is a flame holding tolerant nozzle in accordance with the present invention.

Referring now to FIG. 1, where the invention will be described with reference to specific embodiments, without limiting same, a cross-section through burner assembly 10 is shown. Burner assembly 10 includes an outer peripheral wall 11 and a nozzle center body 12 disposed within the outer wall 11. The fuel/air pre-mixer 14 includes an air inlet 15 a fuel inlet 16, swirl vanes 22 from which fuel is injected, the areas between vanes, defined as vane passages 17, and an annular premixing passage 21 located downstream thereof, between the outer wall 11 and center body 12.

As shown, fuel enters nozzle center body 12 through fuel inlet 16 into fuel passage 23. Fuel impinges upon intermediate wall 24, whereupon it is directed radially into vane passages 26 located within the leading half of vanes 22 and expelled through fuel injection ports 25 into vane passages 17. At the same time, main air is directed into vane passages 17 through air inlet 15. As air passes over the airfoil shape of the vanes 22, it begins mixing with gas fuel being ejected from one or more ports 25 and continues to mix within premixing passage 21. The vanes may be curved to impart a swirl to the fluid. When the fuel/air mixture exits premixing passage 21, it enters a normal combustion zone 30, where combustion takes place. This aerodynamic design is very effective for mixing the air and fuel for low emissions and also for providing stabilization of the flame downstream of the fuel nozzle exit, in the combustor reaction zone.

In full load operation for low-NOx, the flame should reside down stream of the premixing passage 21. Occasionally, flashback of the flame, into premixing passage 21 and/or vane passages 17, will occur. If flashback or another flame inducing event occurs, flame may be held in the pre-mixer and cause damage to the center body 12, burner, and/or vanes 22.

The present invention of an actively cooled burner assembly 10, allows operability of a dry low NOx combustion system that is flame holding tolerant on those occasions when a flame may be held in the burner 10. Accordingly, a cooling gas is introduced into center body 12 through a coolant inlet 31. Coolant travels within cooling passage 32, until it impinges upon the interior of an end wall 33, whereupon the coolant reverses flow and enters a reverse flow passage 34. Reverse flow passage 34 is located concentric to cooling passage 32 and can contain a series of ribs 35 disposed annularly along the flow passage 34 to optimize and enhance heat transfer. Obviously, ribs 35 may take any number of shapes, including discrete arcuate annular rings circumferentially depending from an inner circumferential wall 36 of flow passage 34 or independent nubs also depending from the inner circumferential wall 36 of flow passage 34.

At the end of reverse flow passage 34 opposite end wall 33, coolant impinges upon the intermediate wall 24 and is directed thorough openings 41 into chambers 42 of the trailing half of vanes 22. Coolant passes through chambers 42 and into an annular cavity 43 defined between outer peripheral wall 11 and an interior burner wall 44. A plurality of small holes 45 located within the interior burner wall 44 may be used to allow the coolant to form a film on interior burner wall 44, protecting it from hot combustion gases. Coolant is also directed axially upstream within annular cavity 43, in order that coolant may exit small holes 45 upstream of the leading half of vanes 22.

The flow in FIG. 1 will now be further described. While the fuel enters inlet 16 into fuel passage 23 and exits from injection ports 25, coolant is directed into coolant inlet 31. As it flows within cooling passage 32 it circumferentially cools the interior of passage 32 until it impinges upon end wall 33 providing impingement cooling directly adjacent the combustion reaction zone. As coolant is redirected axially upstream in reverse flow passage 34, backside convection cooling is provided adjacent premixing passage 21. Once coolant is directed through chambers 42 of vanes 22, it enters annular cavity 43 and exits via small holes or orifices 45 to provide film cooling on the interior annular surface 44 of burner wall 11. This actively cooled pre-mixer system allows a flame to be held within premixing passage 21 for a significant amount of time without damage to burner 10. Testing of the devices found that flames were held in the premixer with stable burner wall temperatures observed for up to one minute at a time with no damage occurring. In repeated testing, a flame was held for a cumulative time of more than seven minutes with no damage.

Figure 2:
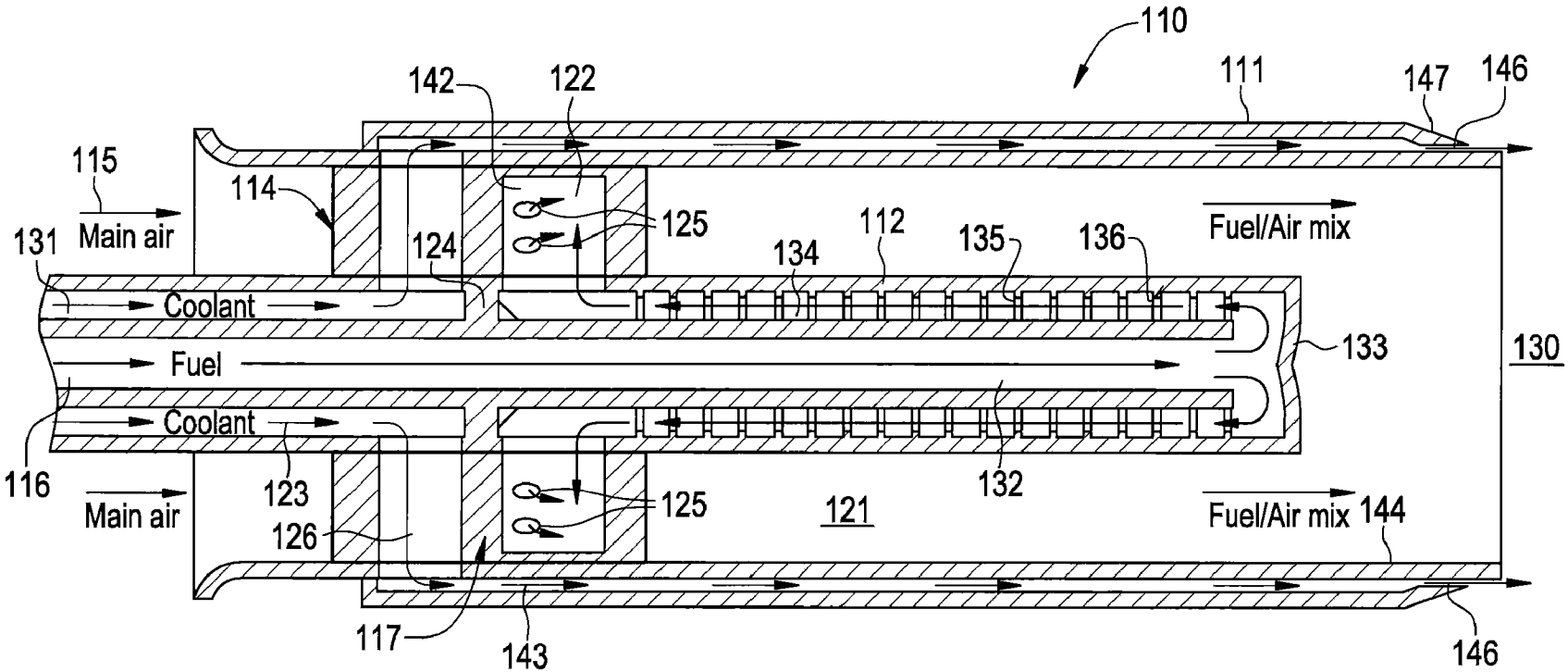
FIG. 2 is another embodiment of the flame holding tolerant nozzle of the present invention.

Referring now to FIG. 2, another embodiment of a burner assembly 110 is shown. The geometry of burner assembly 110 is similar to that of burner assembly 10 and like elements are described with similar reference numerals. However, as will become apparent, the cooling features of burner assembly 110 function differently than burner assembly 10.

Burner assembly 110 includes an outer peripheral wall 111 and a nozzle center body 112 disposed within the outer wall 111. The fuel/air pre-mixer 114 includes an air inlet 115, a fuel inlet 116, swirl vanes 122, the areas between vanes, defined as vane passages 117 and a premixing passage 121 located downstream thereof, between the outer wall 111 and center body 112.

As shown, fuel enters nozzle center body 112 through fuel inlet 116 into fuel passage 132. Fuel travels axially along the entire length of center body 112 and impinges upon the interior of an end wall 133, whereupon the fuel reverses flow and enters a reverse flow passage 134. Reverse flow passage 134 is located concentric to fuel flow passage 132 and can contain a series of ribs 135 disposed annularly along the flow passage 134 to optimize and enhance heat transfer as will be described herein. Like the embodiment of FIG. 1, ribs 135 may take any number of shapes, including discrete arcuate annular rings circumferentially depending from an inner circumferential wall 136 of flow passage 134 or independent nubs also depending from the inner circumferential wall 136 of flow passage 134.

At the axially extending end of reverse flow passage 134 opposite end wall 133, fuel impinges upon an intermediate wall 124 and is directed into chambers 142 located in the middle and trailing portions of vanes 122. Thereupon, fuel is expelled through injection ports 125 into vane passages 117. At the same time, main air is directed into vane passages 117, through air inlet 115. As air passes over the airfoil shape of vanes 122, it begins mixing with the gas fuel being ejected from injection ports 125 and continues to mix within premixing passage 121. By the time the fuel/air mixture exits premixing passage 120, it is substantially fully mixed and enters the combustor reaction zone, were combustion takes place. This burner 110 is very effective for mixing the air and fuel, for achieving low emissions and also for providing stabilization of the flame downstream of the fuel nozzle exit, in the combustor reaction zone.

In order to use fuel as a heat transfer fluid before it is mixed with the air, the cooling features of the burner assembly shown in FIG. 2 are different than the cooling features of FIG. 1. Accordingly, a cooling gas is introduced into center body 112 through a coolant inlet 131 into coolant passage 123. Coolant impinges upon an intermediate wall 124, whereupon it is directed radially into vane passages 126 located within the leading half of vanes 22. Coolant passes through vane passages 126 and into an annular cavity 143 defined between outer peripheral wall 111 and interior burner wall 144. Thereafter, coolant exits annular cavity 143 through an annular orifice 146 located within an annular end wall 147 of outer wall 111 and into a normal combustion zone 130. It will be appreciated that coolant may also be expelled through annular end wall 147 through a series of discrete holes/orifices or arcuate orifices rather than through annular orifice 146.

As can be appreciated from FIG. 2, fuel enters inlet 116 and into fuel passage 132 and exits from injection ports 125, while coolant is directed into coolant inlet 131. However, fuel within fuel passage 132 provides a significant cooling effect as it is directed under pressure. It flows along passage 132 and impinges upon the interior sidewall 133 of center body 112. As the fuel flow is redirected axially upstream in reverse flow passage 134, backside convention cooling is provided adjacent premixing passage 121. Thus, the outer circumferential surface of center body 112 is cooled by both impingement and convection due to fuel flowing in the internal passages of burner 110. Coolant is directed into coolant inlet 131 and coolant passages 123 concentrically surrounding fuel passage 132. Coolant impinges upon the intermediate wall 124 and is redirected radially through vane passages 126 of vanes 122. The burner outer peripheral wall 111 is further cooled by coolant, passing within an annular cavity 143 and exiting small holes 145, thus providing film cooling on interior burner wall 144 and backside convection cooling on the exterior of outer wall 111 as coolant flows through annular cavity 143.

Figure 3:
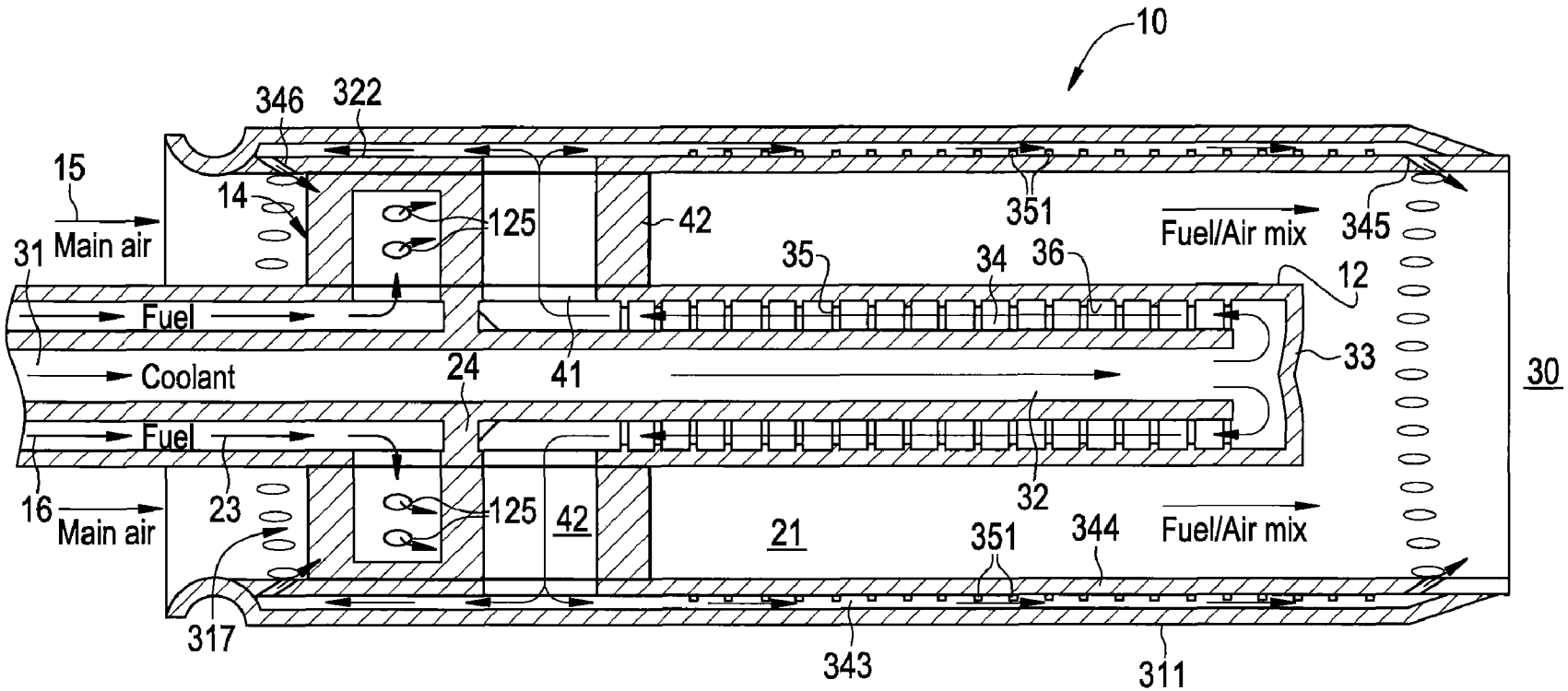
FIG. 3 is yet another embodiment of the flame holding tolerant nozzle of the present invention.

Turning now to FIG. 3, which is a modification of the embodiment of FIG. 1, and uses like numerals for like elements, a modified cooling scheme is shown. Specifically, coolant passes through the vane passages 42 and into an annular cavity 343 defined between an outer peripheral wall 311 and an interior burner wall 344. A plurality of small holes 345 and 346 located within the interior burner wall 344 adjacent an annular end wall 347, and adjacent the leading edge of vanes 222 and vane passages 217, respectively, provide a targeted film cooling along the burner wall 344 in those areas.

Furthermore, a series of ribs 351 is disposed annularly along the outer circumference of the burner wall 344 and within annular cavity 343 to optimize and enhance heat transfer, in a manner like ribs 35 within flow passage 34. It will be appreciated that ribs 351 may take any number of shapes within annular cavity 343 including arcuate annular rings or independent nubs extending from burner wall 344 into annular cavity 343.

In the embodiments shown, the cooling fluid is flowed at all times the combustor is in operation to allow the premixer to tolerate a flashback or flame holding event at any instant.

It will be appreciated by one skilled in the art, that film-cooling geometry may vary greatly depending on the application and nozzle size. Adequate cooling may be different depending on the type of fuel used, fuel and air flow velocities and specific geometries governing injection and mixing of the fuel. As an mixer example, it has been found that for a nozzle in the 1.5 inch diameter range using a high hydrogen fuel, adequate film cooling has been achieved when the pitch or lateral spacing between adjacent coolant outlet orifices is approximately two to five times the diameter of the film-cooling orifice. Furthermore, the angle of injection of coolant relative to the plane of the outer peripheral wall can vary between 20 and 90 degrees. Finally, it has been found to improve cooling when coolant is injected at an additional compound angle relative to an axial flow direction in the burner. That compound angle can also vary from 20 to 90 degrees, but testing shows an angle of approximately 30 degrees works in many different situations.

It will be appreciated by one skilled in the art that many types of gas coolant can be used and may vary from one embodiment to another. The coolant may vary depending on such factors including, but not limited to, availability and amount of coolant at the plant site, the cost of compressing the coolant to a required pressure, the physical properties of the coolant, and the benefits of an inert gas when film cooling is used. For instance, when the coolant comprises an inert gas, such as nitrogen, the film cooling on the burner wall 44 or 144 also serves to substantially isolate the wall from any species participating in the combustion reaction, which may further reduce the risk of damage. Coolant may also be one of any number working fluids including, but not limited to, nitrogen, air or fuel. Indeed, as described herein, a combination of different cooling fluids is also possible depending on nozzle design and system properties.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel nozzle comprising:

an outer peripheral wall and an inner peripheral wall proximate said outer wall, said outer wall and said inner wall defining an annular cavity therebetween, said annular cavity forming a peripheral cooling passage;

a nozzle center body disposed within said outer wall, the nozzle center body comprising:

an end wall at a distal end thereof;

a gas fuel passage defined within said nozzle center body and extending at least part of a length therein; and a nozzle cooling passage defined within said nozzle center body and extending at least part circumferentially of a length therein, the nozzle cooling passage defining an inlet for flow of a cooling fluid;

a fuel/air premixer surrounding a proximal end portion of said nozzle center body and including an air inlet, a fuel inlet, and a plurality of vanes in flow communication with the fuel inlet;

wherein said inner peripheral wall and said nozzle center body define a premixing passage therebetween, into which said premixing passage said fuel/air premixer discharges; and wherein said cooling fluid is conveyed from said nozzle cooling passage to said peripheral cooling passage;

wherein said nozzle cooling passage is in fluid communication with a source of air or inert gas; and wherein said peripheral cooling passage is in flow communication with said premixing passage through at least one outlet orifice.

2. The nozzle of claim 1, wherein said nozzle cooling passage is in flow communication with said premixing passage.

3. The nozzle of claim 1, wherein said nozzle cooling passage includes annularly spaced ribs disposed therein.

4. The nozzle of claim 1, wherein said nozzle center body further comprises an outer wall defining at least one orifice therein, and wherein said nozzle cooling passage includes a first portion and a second portion concentrically surrounding a length of the first portion, the first portion terminating at said end wall of said nozzle center body, and said second portion extending from said end wall to the at least one orifice located in the outer wall of said nozzle center body.

5. The nozzle of claim 4, wherein the at least one orifice is in flow communication with said premixing passage.

6. The nozzle of claim 1, wherein said plurality of vanes includes internal cooling passages, said internal cooling passages within said plurality of vanes being in flow communication with said nozzle cooling passage and said peripheral cooling passage.

* * * * *